US006112466A

United States Patent [19]

Smith et al.

[11] Patent Number: 6,112,466

[45] Date of Patent: Sep. 5, 2000

[54] SEAL MECHANISM FOR PARTITION

[75] Inventors: Garrick D. S. Smith, McFarland; Oliver M. Julien, Merrimac, both of Wis.

[73] Assignee: Hufcor, Inc., Janesville, Wis.

[21] Appl. No.: 08/802,960

[22] Filed: Feb. 21, 1997

[51] Int. Cl.[7] ..... E06B 7/20

[52] U.S. Cl. ..... 49/306; 49/317; 49/320; 160/40

[58] Field of Search ..... 160/40, 201, 196.1, 160/199, 206; 49/303, 306, 316, 317, 318, 320, 321

[56] References Cited

U.S. PATENT DOCUMENTS

| | | | |
|---|---|---|---|
| 3,068,936 | 12/1962 | Haws | 160/40 |
| 3,295,257 | 1/1967 | Douglass | 49/317 |
| 3,295,588 | 1/1967 | Gilson | 49/317 X |
| 3,374,821 | 3/1968 | White | 49/316 X |
| 3,450,185 | 6/1969 | Holloway | 150/199 |
| 3,802,480 | 4/1974 | Daggy | 160/40 |
| 4,014,137 | 3/1977 | Williams | 49/321 |
| 4,277,920 | 7/1981 | Dixon | 49/321 X |
| 4,535,578 | 8/1985 | Gerken | 52/243.1 |
| 5,339,881 | 8/1994 | Owens | 160/40 |

*Primary Examiner*—David M. Purol
*Attorney, Agent, or Firm*—Michael Best & Friedrich LLP

[57] ABSTRACT

Operable partitions arrangements having operable seal mechanisms such that a seal can be created, when so desired, between the panel and a surface such as a floor, a ceiling, a wall, other panels, or other structures located adjacent the panel. The invention provides a seal mechanism which operates to actuate a seal member against the surface and operates to withdraw the bias of seal member from the surface thereby releasing the seal made with the surface. The invention provides a partition including a panel having an interior, a seal member moveable with respect to the panel, a rotatable cam housed in the interior of the panel, and a connector extending between the seal member and the cam, whereby rotation of the cam in a first direction moves the seal member away from the panel to a first position and rotation of the cam in a second direction moves the seal member toward the panel to a second position.

62 Claims, 11 Drawing Sheets

22
3
26
26
20

28
78
32
4
4
64
18
60
34
5
5
3

SEAL MECHANISM FOR PARTITION

FIELD OF THE INVENTION

The invention relates to a seal mechanism for selectively moving a seal member, and more particularly, to a seal mechanism for use with a partition for selectively moving at least one seal member to actuate and release a seal between the panel and a surface such as a floor or ceiling.

BACKGROUND OF THE INVENTION

Operable partitions are used in hotels, schools, convention halls, offices and many other locations where it is desirable to subdivide a large room space into smaller room spaces. Operable partition arrangements typically include panels suspended from an overhead track with the panels being movable along the track. The partition arrangements typically include a storage space into which the panels can be moved for storage when subdividing a large room space is not desired.

It is desirable to provide seal mechanisms in the operable partition arrangement such that a seal can be created, when so desired, between the panel and the ceiling above the panel or between the panel and the floor below the panel, or both. It is also desirable to provide seal mechanisms such that a seal can be created between the panel and other panels, walls, or other structures located to the sides of the panel. Such seals enhance the panels effectiveness as a barrier by, among other things, blocking air flow and noise and providing stability to the position of the panel.

Immobile sweep seals are seal mechanisms that attach to the top or bottom of a panel. The problem with immovable sweep seals is that they cannot practically be made to seal tightly against the floor or ceiling. If sweep seals are made to seal tightly, it is difficult or impossible to move a panel while the seal is in place. Sweep seals are not releasable so the panels cannot be easily moved when so desired. Additionally, due to the friction that is created between sweep seals and the floor or ceiling, sweep seals are more susceptible to wear.

Another type of seal mechanism is an operable seal. Operable seals include vertically moveable seal members located at the upper and lower portions of the panels. The seal members are actuated to form a seal against the floor and/or ceiling. The problem with conventional operable seals has been in providing a lightweight, low cost, easy to manufacture, and easy to use seal mechanism.

SUMMARY OF THE INVENTION

The invention provides a seal mechanism which operates to actuate a seal member against a surface such as a floor, a ceiling, or a wall, and form a seal with the surface and operates to withdraw the bias of seal member from the surface thereby releasing the seal made with the surface.

More specifically, the invention provides a partition including a panel having an interior, a seal member moveable with respect to the panel, a rotatable cam housed in the interior of the panel, and a connector extending between the seal member and the cam, whereby rotation of the cam in a first direction moves the seal member away from the panel to a first position and rotation of the cam in a second direction moves the seal member toward the panel to a second position.

It is an object of the present invention to provide an improved seal mechanism for a partition.

It is another object of the present invention to provide a partition seal mechanism that overcomes the problems of conventional seal mechanisms.

It is another object of the present invention to provide a partition seal mechanism that selectively moves a seal member.

It is another object of the present invention to provide a partition seal mechanism that is operable to selectively form a seal with a surface and release the seal from that surface.

It is another object of the present invention to provide a partition seal mechanism that includes two moveable seal members.

It is another object of the present invention to provide a partition seal mechanism that is easy to operate.

It is another object of the present invention to provide a partition seal mechanism that is less costly and easier to manufacture.

It is another object of the present invention to provide a partition seal mechanism that is lightweight.

It is another object of the present invention to provide a partition with an improved seal mechanism.

It is another object of the present invention to provide a partition with a seal mechanism such that the seal mechanism selectively actuates and releases a seal between the partition and the floor and/or ceiling.

These and other features and advantages of the invention will become apparent upon review of the following detailed description of the preferred embodiment of the invention, claims, and drawings.

Figure 1:
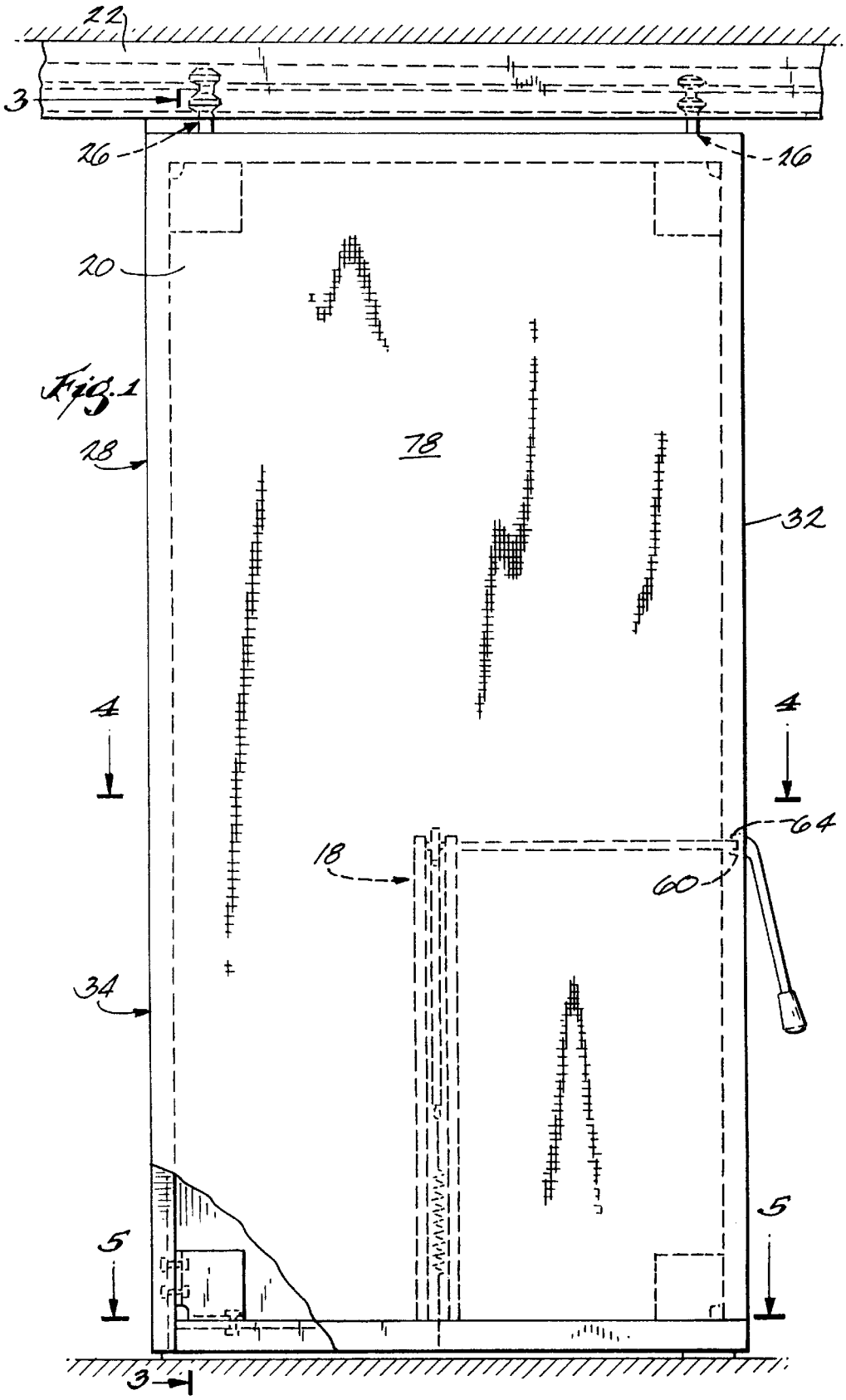
FIG. 1 is a front view of a seal mechanism and a partition arrangement in a first embodiment of the invention.

Before embodiments of the invention are explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Referring to FIG. 1, there is shown a first embodiment of a seal mechanism 18 embodying the invention. The seal mechanism 18 is shown in conjunction with a partition 20. Partitions are used in rooms for selectively subdividing the room into smaller areas. It should be noted that the seal mechanism 18 is operational with other arrangements that require operable seals. The seal mechanism 18 will be described hereafter in conjunction with the partition 20.

As shown in FIG. 1, the partition 20 includes a track 22 which is secured to a support structure A such as a ceiling, one or more carriers 26 that interengage with the track 22, and a panel 28 that is supported by the carriers 26. The configuration of the track 22 and the carriers 26 as well as the interengagement of the track 22 and the carriers 26 is described in U.S. Pat. No. 5,406,676 issued to Williams on Apr. 18, 1995 which is incorporated herein by reference.

Figure 2:
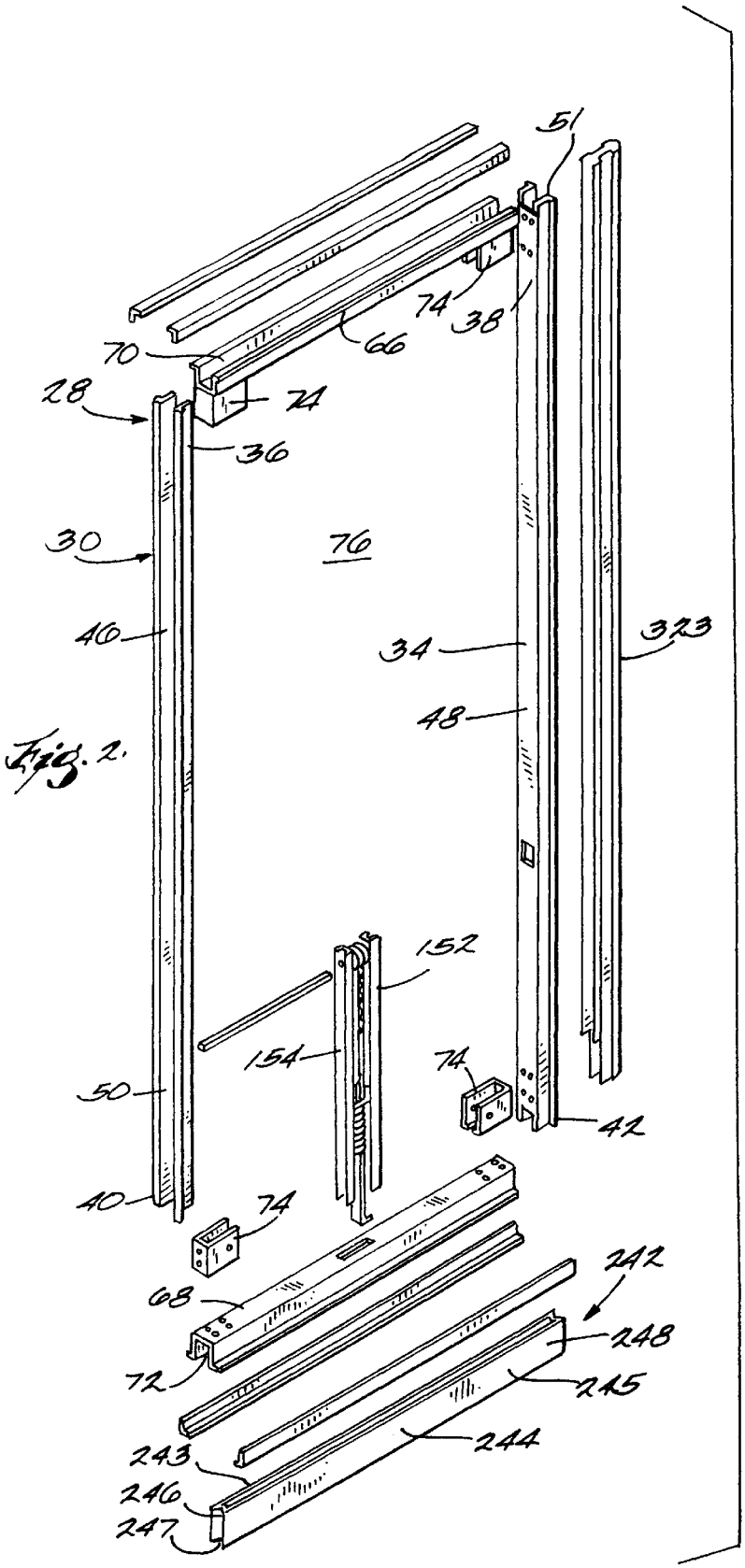
FIG. 2 is an exploded perspective view of a panel and the seal mechanism.
Figures 4, 13:
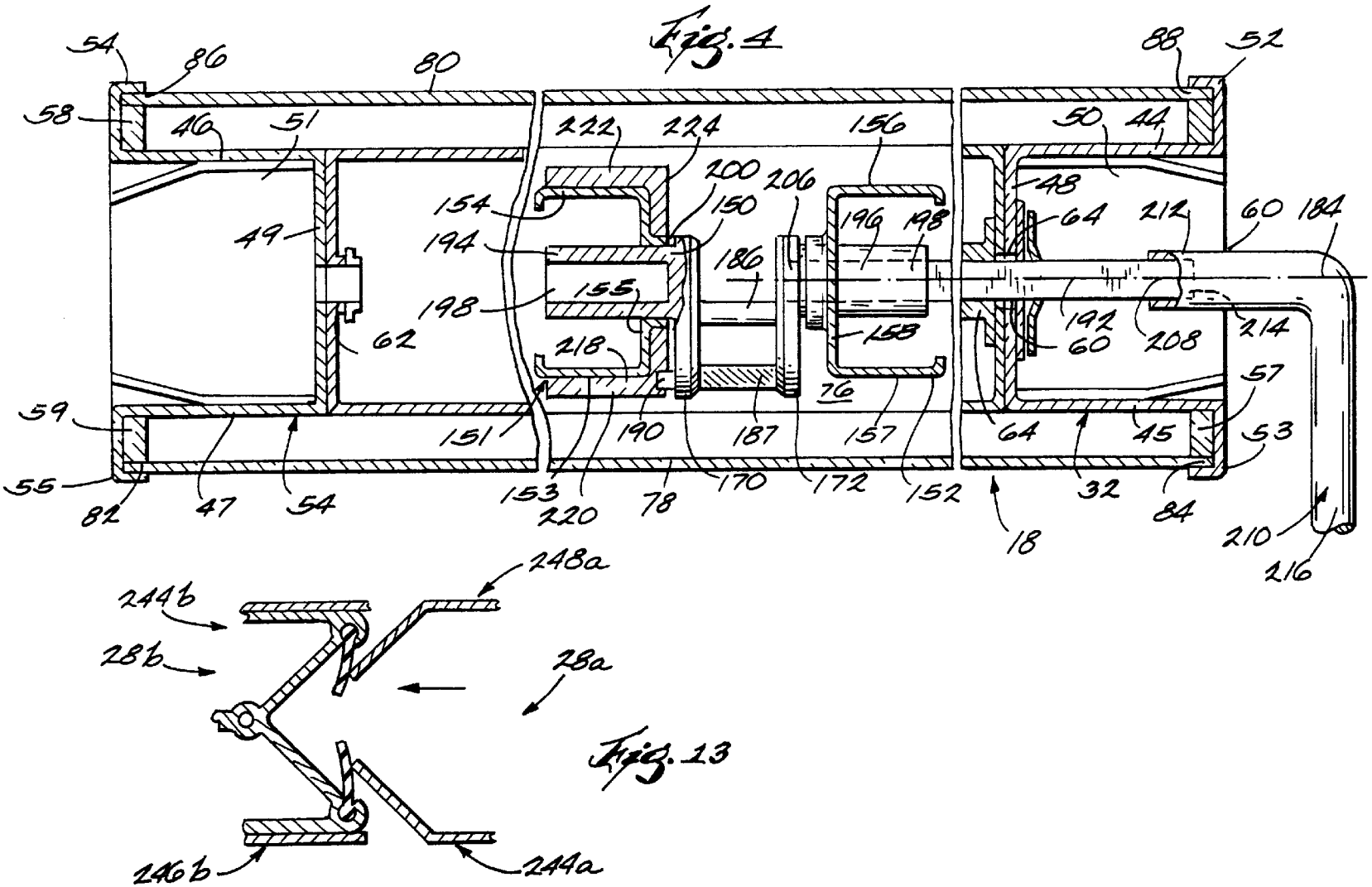
FIG. 4 is a partial sectional view taken along line 4—4 of FIG. 1.
FIG. 13 is a partial sectional view taken along line 13—13 of FIG. 11.

Referring to FIG. 2, the panel 28 includes a frame 30. The frame 30 includes a pair of side rails 32 and 34 that are generally U-shaped in cross-section having first ends 36 and 38 respectively and second ends 40 and 42 respectively. As best shown in FIG. 4, the side rail 32 is defined by two legs 44 and 45 and a web 48 therebetween that cooperate to define a channel 50. The side rail 34 is defined by two legs 46 and 47 and a web 49 therebetween that cooperate to define a channel 51. On the end of each leg 44, 45, 46 and 47 is a L-shaped lip 52, 53, 54, and 55 respectively. The lip 52 and the leg 44 define a channel 56. The lip 53 and the leg 45 define a channel 57. The lip 54 and the leg 46 define a channel 58. The lip 55 and the leg 47 define a channel 59. The side rail 32 has therein an aperture 60. The side rail 32 further includes a bearing assembly 64 co-axial with the aperture 60.

As best shown in FIG. 2, a top rail 66 extends between the first ends 36 and 38 of the side rails 32 and 34 and a bottom rail 68 extends between the second ends 40 and 42 of the side rails 32 and 34. The top and bottom rails 66 and 68 are generally U-shaped in cross section and define channels 70 and 72 respectively. Optionally, an intermediate rail (not shown) may extend between the side rails 32 and 34 and be positioned between the top rail 66 and the bottom rail 68. For simplicity, FIG. 2 does not illustrate an intermediate rail. However, it should be noted that the need for intermediate rails may be dependent upon the dimensions of the panel 28. Larger panels may require at least one or more intermediate rails between the top rail 66 and the bottom rail 68 for structural support.

Continuing to refer to FIG. 2, corner brackets 74 are positioned at the junctions of the top rail 66 and the side rail 32, the top rail 66 and the side rail 34, the bottom rail 68 and the side rail 32, and the bottom rail 68 and the side rail 34. The corner brackets 74 are secured in place with fasteners such as screws. The corner brackets 74 rigidly interconnect the top rail 66, the bottom rail 66 and the side rails 32 and 34 to form the frame 30. The frame 30 defines an inner cavity 76.

As shown in FIGS. 1 and 4, the frame 30 of the partition 20 is hidden from view through use of two covering side members 78 and 80. Preferably, the side members 78 and 80 are sheets of wallboard that are generally a non-metal sheet material such as gypsum, fiberboard, plywood or other wood, plasterboard, plaster, sheetrock, particle board, or other like materials. Alternately, the side members 78 and 80 could be made of metal, or other non-wallboard material. Preferably, the side members 78 and 80 have a length that generally corresponds to the length of the side rails 32 and 34 and have a width that generally corresponds to the distance between the side rails 32 and 34.

Referring now to FIG. 4, the side member 78 has an edge 82 and an edge 84. The side member 78 is oriented such that the edge 82 is positioned in the channel 59 and the edge 84 is positioned in the channel 57. The lips 55 and 53 of the respective side rails 34 and 32 maintain the side member 78 in proper position. Similarly, the side member 80 has an edge 86 and an edge 88. The side member 80 is oriented such that the edge 86 is placed in the channel 58 and the edge 88 is positioned in the channel 56. The lips 54 and 52 of the respectively side rails 34 and 32 maintain the side member 80 in proper position.

Figure 3:
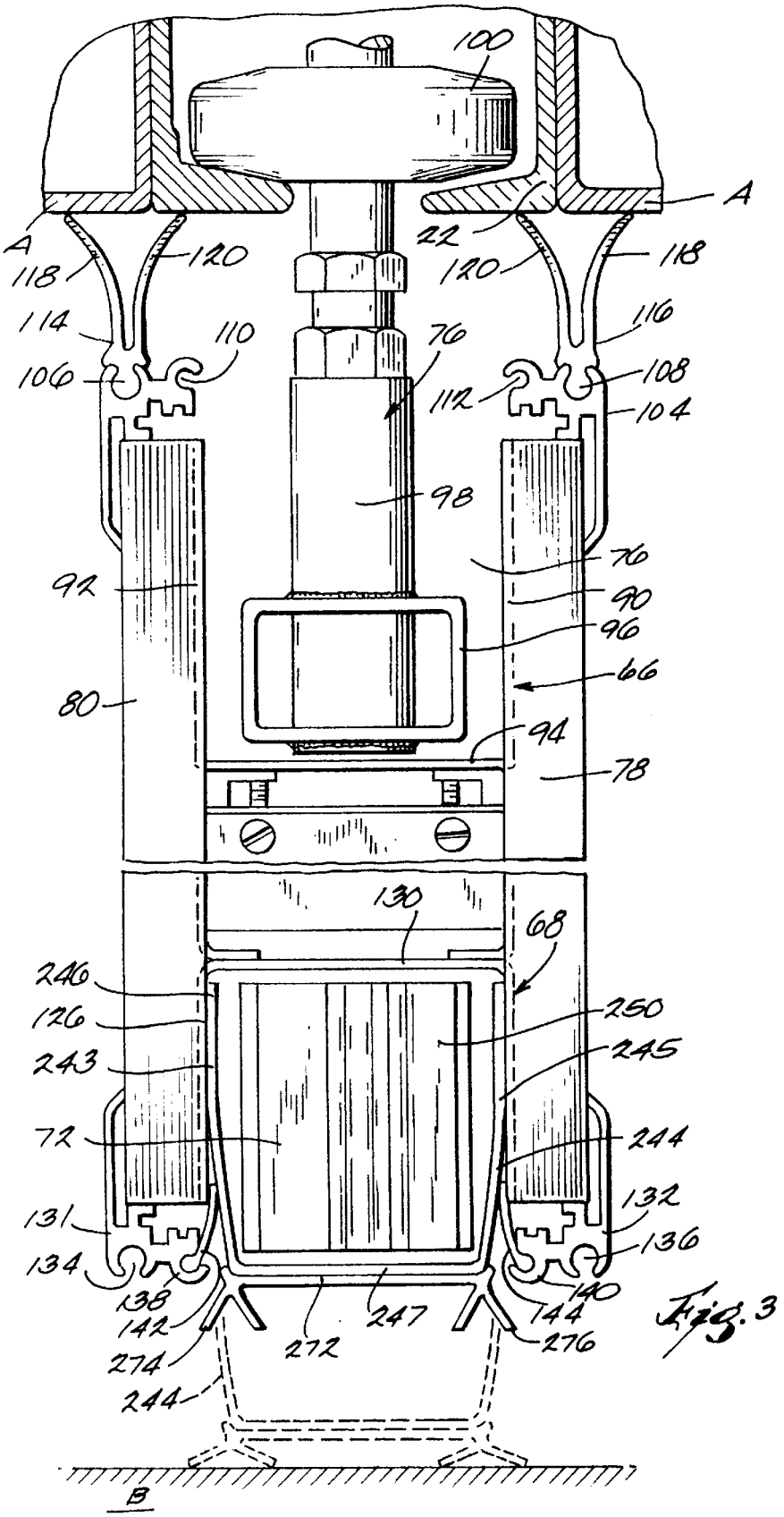
FIG. 3 is a partial sectional view taken along line 3—3 of FIG. 1.

As illustrated in FIG. 3, the top rail 66 includes two legs 90 and 92 and a web 94 therebetween. Preferably, the top rail 66 is positioned between the side rails 32 and 34 such that the legs 90 and 92 of the top rail 66 terminate in the same plane that the top edges of the side rails 32 and 34 terminate. A mounting bracket 96 is adjacent the web 94. The mounting bracket 96 secures the carrier 26 to the frame 30. The carrier 26 includes a bolt 98 and preferably two discs 100 of which only one disc 100 is shown in FIG. 3. The mounting bracket 96 surrounds the bolt 98. The bolt 98 extends upwardly to enable the discs 100 on the end of the bolt 98 to interengage with the track 22.

A trim member 104 is secured to the top edge of the side member 78 and a trim member 102 is secured to the top edge of the side member 80. The trim members 102 and 104 are secured to the respective side member 78 and 80 with fasteners such as screws. Each trim member 102 and 104 includes two C-shaped grooves; grooves 106 and 108 respectively open upwardly in a direction away from the panel 28 and grooves 110 and 112 respectively open in a direction toward the inner cavity 76 of the panel 28. Generally V-shaped seals 114 and 116 are positioned in the grooves 106 and 108 respectively via tongue-and-groove engagement. Each seal 114 and 116 includes two fingers 118 and 120 that are designed to contact a surface such as a ceiling or such as the track 22.

Continuing to refer to FIG. 3, the bottom rail 68 includes two legs 126 and 128 and a web 130 therebetween. Preferably, the bottom rail 68 is positioned between the side rails 32 and 34 such that the legs 126 and 128 terminate in the same plane as the bottom edges of the side rails 32 and 34 terminate. A trim member 131 is secured to the bottom edge of the side member 80 and a trim member 132 is secured to the bottom edge of the side member 78. The trim members 131 and 132 are secured to the respective side member 78 and 80 with fasteners such as screws. Each trim member 131 and 132 includes two C-shaped grooves; bottom grooves 134 and 136 respectively open downwardly in a direction away from the panel 78 and side grooves 138 and 140 respectively open in a direction toward the inner cavity 76. Tadpole seals 142 and 144 are positioned in the side groove 138 and 140 respectively via a tongue-and-groove engagement.

Figures 6, 7:
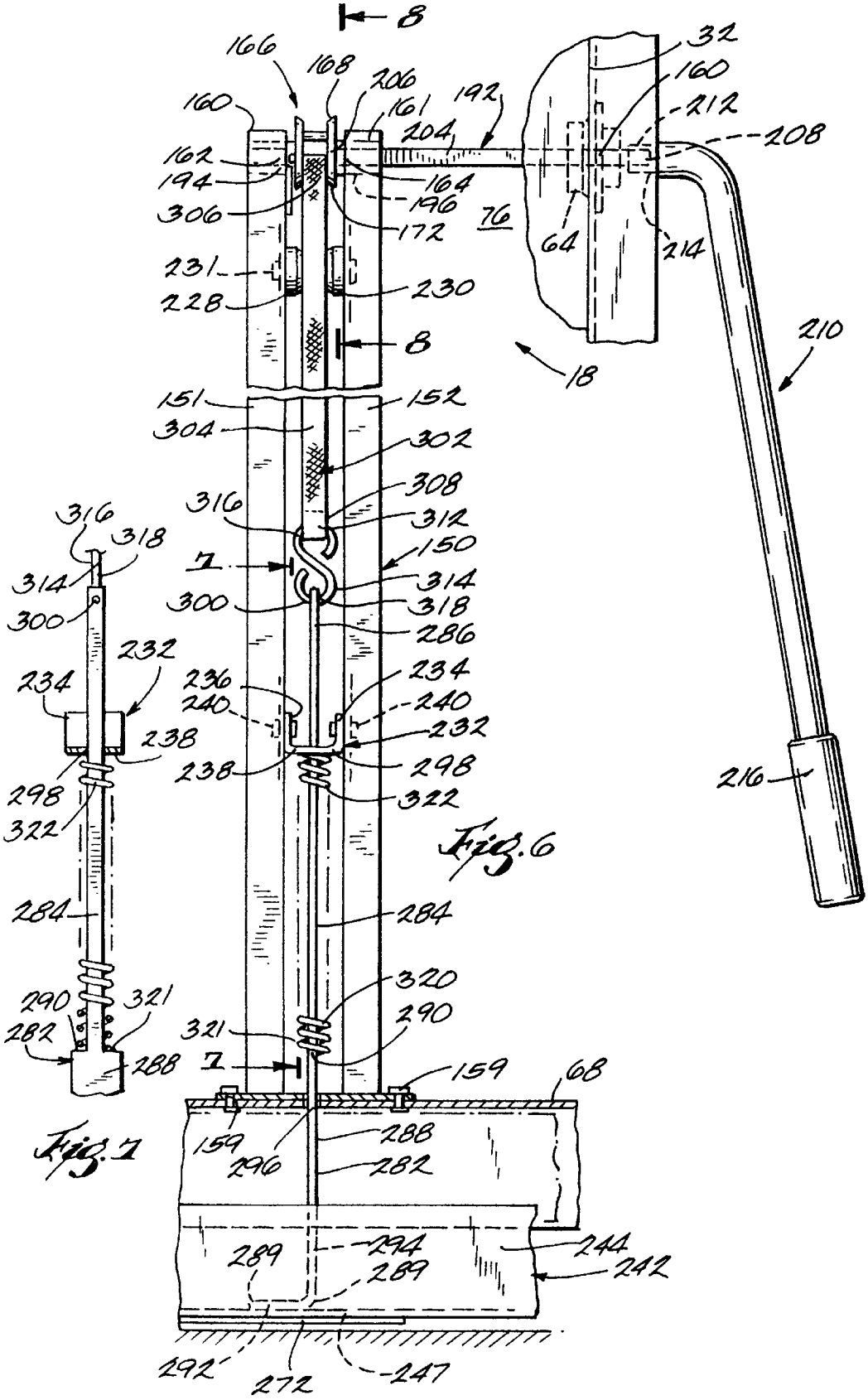
FIG. 6 is a partial front view of the first embodiment particularly showing the seal mechanism.
FIG. 7 is a view taken along line 7—7 of FIG. 6.

Referring now to FIGS. 4 and 6, the seal mechanism 18 is particularly shown. The seal mechanism 18 includes a support frame 150. As best shown in FIG. 4, the support frame 150 includes two elongate supports 151 and 152 that are generally C-shaped in cross-section. Support 151 is defined by a leg 153 and a leg 154 interconnected by a web 155. Support 152 is defined by a leg 156 and a leg 157 interconnected by a web 158. The supports 151 and 152 are orientated in parallel such that they open away from each other. As best shown in FIG. 6, the supports 151 and 152 are secured to the bottom rail 68 with fasteners 159 such as nuts and bolts or by welding. Each support 151 and 152 terminates in a top edge 160 and 161 respectively. Adjacent the top edges 160 and 161 is an axially aligned aperture 162 and 164.

Figure 10:
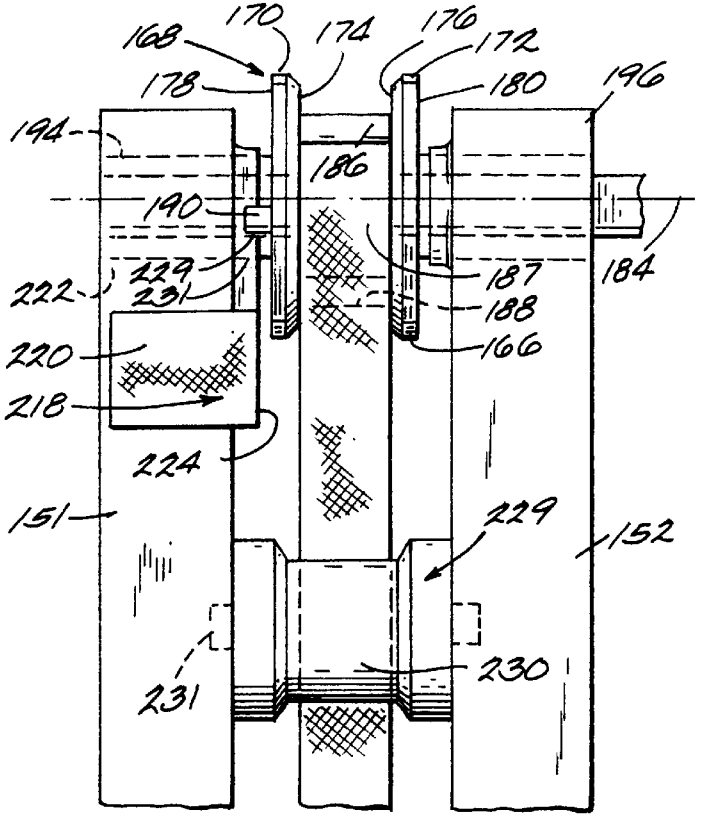
FIG. 10 is a partial front view of the first embodiment.
Figure 9:
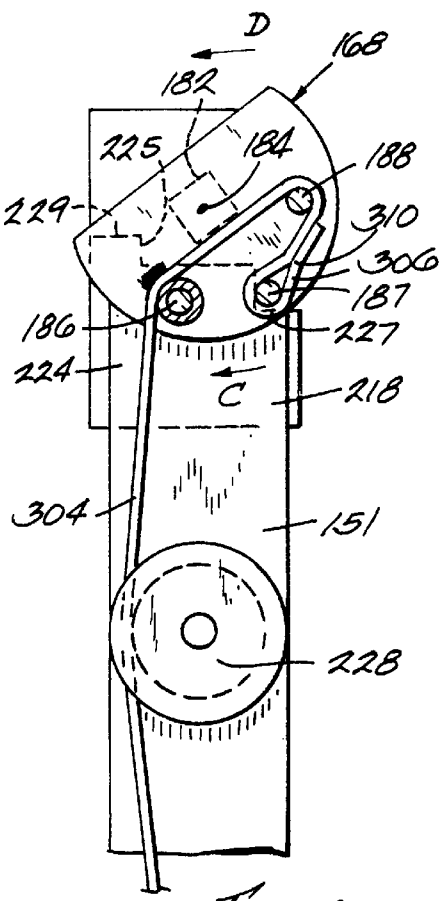
FIG. 9 is a side view taken along line 8—8 of FIG. 6 with the cam assembly in a second position.
Figure 8:
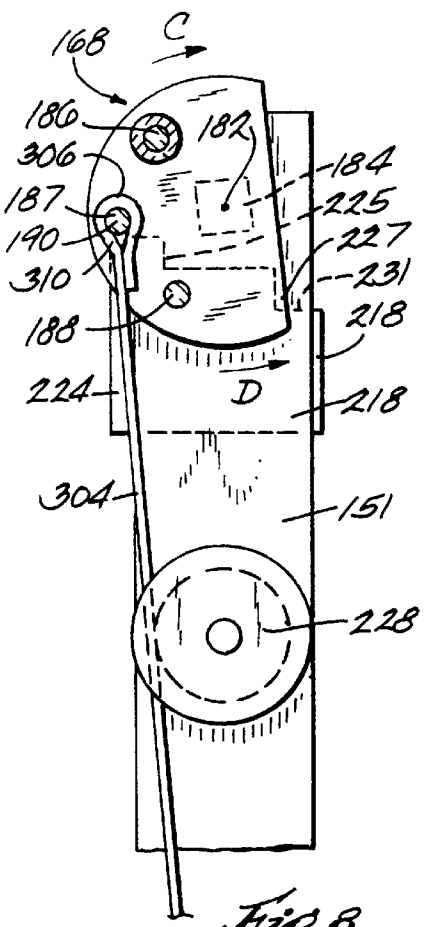
FIG. 8 is a side view taken along line 8—8 of FIG. 6 with the cam assembly in a first position.

As shown in FIG. 10, the seal mechanism 18 further includes a cam assembly 166. The cam assembly 166 includes a cam 168. The cam 168 includes two spaced plates or discs 170 and 172, each disc 170 and 172 having an inside surface 174 and 176 respectively and an outside surface 178 and 180 respectively. Referring to FIGS. 8 and 9, the discs 170 and 172 are preferably semi-circular in shape and each disc 170 and 172 has therein an axially aligned aperture 182 that is preferably square. It should be noted that the apertures 182 may be shaped differently such as circular or triangular. The apertures 182 are co-axial with an axis 184 about which the cam 168 rotates (FIG. 10). Referring to FIGS. 8–10, the discs 170 and 172 are connected with each other by three pins or rods 186, 187, and 188 that extend between and are connected to each of the discs 170 and 172. The rod 187 has a first end 190 that extends through and beyond the disc 170 (FIG. 10).

Referring back to FIG. 4, a cam rotating assembly 192 is interconnected with the cam 168 and includes a pair of actuation sockets 194 and 196. The actuation sockets 194 and 196 are elongated and preferably circular in cross-section having therein a central square bore 198. The actuation socket 194 extends through and is rotatably supported by the aperture 162 in the adjacent elongate support 151. The actuation socket 196 extends through and is rotatably supported by aperture 164 in the elongate support 152. The actuation sockets 194 and 196 are secured to the outside surfaces 178 and 180 of the discs 170 and 172 respectively such that the bores 198 are co-axial with the axis of rotation 184 (FIG. 10). A bearing 200 surrounds that portion of the socket 194 that is between the cam disc 170 and the support 151 and a bearing 202 surrounds that portion of the socket 196 that is between the cam disc 172 and the support 152.

Referring to FIG. 6, an elongate actuation rod 204 extends from the socket 196 to outwardly of the side rail 32. Preferably, the actuation rod 204 is an elongate rigid bar that is square in cross-section and is made of steel. It should be noted, however, that the actuation bar 204 may have a different cross sectional shape, and may be fabricated of different rigid materials. The actuation rod 204 has a first end 206 that is positioned in the aperture 182 of the cam disc 172. Thereafter, the rod 204 extends through the bore 198 of the socket 196, through the cavity 76, through the bearing assembly 64, then through the aperture 60 in the side rail 32 to terminate in a second end 208.

The actuation rod 204 fits snugly into the aperture 182 of the cam disc 172 and fits snugly into the bore 198 in socket 196. The bearing assembly 64 surrounds the actuation rod 204 at the point where the actuation rod 204 extends through the aperture 60. The bearing assembly 64 rotatably supports the actuation rod 204 for rotation about the axis 184.

The second end 208 of the actuation rod 204 is adapted to interengage with an actuation tool 210. The actuation tool 210 is preferably a generally L-shaped rod having a substantially hollow first end 212. The first end 212 has therein a substantially square shape bore 214 adapted to snugly receive the second end 208 of the actuation rod 204. The actuation tool 210 has a second end 216 that extends at an angle from the first end 212. The second end 216 acts as a handle for an operator to rotate the actuation tool 210, thereby rotating the actuation rod 204, and thereby rotating the cam 166 about the axis of the rotation 184.

It should be noted that there are alternative embodiments that may be used for the actuating tool 210. For example, many types of wrenches, levers or handles may be adapted to rotate the actuation rod 204. Additionally, a tool adapting assembly may be connected to the second end 208 of the actuation rod 204 for selective engagement with many different type of actuation tools.

As best shown in FIGS. 4 and 8, the seal mechanism 18 further includes a motion limiting bracket or cam stop 218 secured to and supported by the support member 151. The bracket 218 is generally C-shaped having a leg 220, a leg 222 and a web 224 therebetween. As best shown in FIG. 8, the web 224 has therein a first notch 225, a second notch 227, a lip 229 and a lip 231 giving the web 224 a stair-stepped shape. The bracket 218 is secured to the support member 151 in close proximity to the cam 168 such that the leg 222 abuts the leg 154, the web 224 abuts the web 155, and the leg 220 abuts the leg 153 (FIG. 4).

Referring now to FIG. 10, a spool 228 rotatably extends between the support members 151 and 152. The spool 228 includes a reel 230 and a spindle 233 extending therethrough. The spindle 233 extends between and is connected to each of the support members 151 and 152. The reel 230 is rotatable in relation to the spindle 233.

Referring to FIGS. 6 and 7, a stop bracket 232 extends between and is supported by the support members 151 and 152 at a point below the spool 228. The bracket 232 is substantially U-shaped having two legs 234 and 236 and a web 238. The leg 236 is attached to the support member 151, and the leg 234 is attached to the support member 152 such that the web 238 extends between the supports 151 and 152. The legs 234 and 236 are attached to the supports 152 and 154 with fasteners 240 such as bolts or screws.

Referring now to FIG. 2, the seal mechanism 18 includes a vertically moveable lower seal member 242. It should be noted that in other embodiments of the invention an upper seal member is also used and will be described herein in relation to another embodiment.

The seal member 242 includes an elongate seal carrier 244 that is generally U-shaped in cross-section and has a first end 246 and a second end 248. The seal carrier 244 includes two legs 243 and 245 and a web 247 therebetween.

Figure 5:
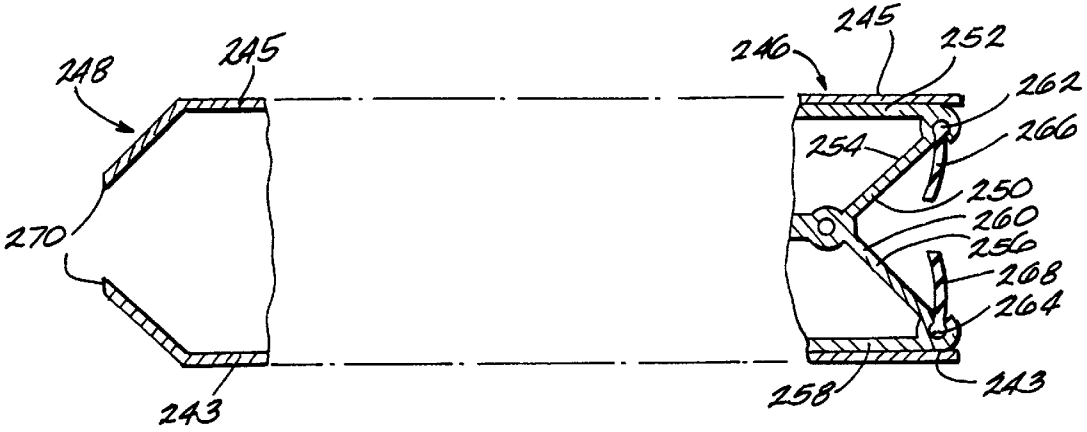
FIG. 5 is a sectional view taken along line 5—5 of FIG. 1.

Referring to FIG. 5, a side trim member 250 is interconnected between the legs 243 and 245 at the first end 246 of the seal carrier 244. Trim member 250 is substantially sigma-shaped in horizontal cross section and has four legs 252, 254, 256 and 258. The leg 252 is connected to the leg 254, the leg 254 is in turn connected to the leg 256, the leg in turn is connected to the leg 258. The leg 252 is attached to the leg 245 of the seal carrier 244, and leg 258 is attached to the leg 243 of seal carrier 244. The junction of the leg 254 and the leg 256 forms a substantially concave outer surface 260. At the junction of the legs 252 and 254, a substantially C-shaped groove 262 is formed. At the junction of the legs 256 and 258, a substantially C-shaped groove 264 is formed. Tadpole seals 266 and 268 are attached to the grooves 262 and 264 respectively through a tongue and groove engagement.

The legs 243 and 245 of the seal carrier 244 are angled inward toward one another at the second end 248 of the seal carrier 244 to form a substantially convex outer surface 270 at the second end 248. The curvature of the trim member 250 forming the concave outer surface 260 at the first end 246 of the seal member 244 is substantially complimentary to the curvature of the convex outer surface 270 of the second end 248 of the seal carrier 244.

As best shown in FIG. 3, a seal shoe 272 is attached to the bottom surface of the web 247 of the seal carrier 244. The seal shoe 272 is attached to the seal carrier 244 with fasteners such as foam tape or screws. The seal shoe 272 includes two sweep seals 274 and 276.

Continuing to refer to FIG. 3, the tadpole seals 142 and 144 are positioned between the bottom rail 68 and the seal carrier 244 for frictional engagement to create a seal between the seal carrier 244 and the bottom rail 68. The tadpole seals 142 and 144 enhance the partition 20 effectiveness as a barrier by blocking air and noise from flowing between the vertically operable seal carrier 244 and the bottom rail 68.

As best shown in FIGS. 2 and 3, the channel 72 in the bottom rail 68 is adapted to house at least a portion of the seal carrier 244. The legs 243 and 245 of seal carrier 244 fit within the channel 72. The seal carrier 244 is designed such that it can be housed in the channel 72 of the bottom rail 68 without any significant air gaps. The seal carrier 244 is designed so that it may be moved into and out of the channel 72 in a vertical direction as shown in phantom in FIG. 3.

Referring to FIGS. 6 and 7, the seal member 242 further includes a link arm 282. The link arm 282 has a narrow first portion 284 terminating in a first end 286 and a wide second portion 288 terminating in a second end 289. A shoulder 290 is formed at the point at which the first portion 284 and second portion 288 meet. The second portion 288 is generally L-shaped including a leg 292 and a leg 294. The link arm 282 is secured to the seal carrier 244 by securing the leg 292 to the web 247 such as by welding. The link arm 282 extends upwardly from the second end 289 through an aperture 296 in the web 130 of the bottom rail 68 such that the link arm 282 extends between the support members 151 and 152, and through an aperture 298 in the bracket 232. The bracket 232 surrounds a portion of the first portion 284 of the link arm 282, and is spaced vertically above the shoulder 290. The first end 208 of the link arm 282 has an aperture 300 therein.

A connector 302 interconnects the link arm 282 and the cam 168. Preferably, the connector 302 includes a strap 304 and a S-hook 314. The strap 304 has a first end 306 and a second end 308. The first end 306 has a loop 310 that surrounds the rod 187 thereby connecting the strap 304 to the cam assembly 166 (FIG. 8). The second end 308 has a loop 312 that is connected to the link arm 282 by the S-hook 314. One end 316 of the S-hook 314 is housed in the loop 312 and the other end 318 of the S-hook 314 is housed in the aperture 300 of link arm 282. It should be noted that although an S-hook 314 is shown, different connecting means may be used to connect the strap 304 to the link arm 282 such as directly securing the strap 304 to the link arm 282.

Continuing to refer to FIGS. 6 and 7, a biasing member such as an actuation spring 320 surrounds the narrow first portion 284 of the link arm 282 between the shoulder 290 and the bracket 232. The spring 320 has a first end 322 abutting the shoulder 290 and a second end 324 abutting the bracket 232. The spring 320 is narrower in diameter than the wide second portion 288 of the link arm 282, and therefore is held in position by the shoulder 290 and the bracket 232. The spring 320 is preferably a compression spring. Although the illustrated embodiment shows spring surrounding the link arm 282, other biasing means may be used.

In operation, the spring 320 in conjunction with the link arm 282 act as means for extending the seal member 242 outwardly from the panel 28. The spring 320 reacts against the bracket 232 and the shoulder 290 to provide a downward force on the shoulder 290, thereby providing a downward force on the link arm 282 which in turn moves the seal carrier 244 downwardly.

The seal mechanism 18 also includes means for moving the seal member 242 toward the panel 28 so as to withdraw the seal member 242 from sealing engagement with a surface such as a floor. When it is desired to move the seal member 242 into the panel 28, the actuation tool 210 is engaged with the second end 208 of the actuation rod 204 and the actuation tool is rotated. As best shown in FIGS. 8 and 9, as the actuating rod 204 is rotated, the actuation socket 196 rotates thereby rotating the cam 168 and a portion of the strap 304 is wound onto the cam 168 about the pins 186 and 188 thereby shortening the effective length of the strap 304. The effective shortening of the strap 304 results in a motion that pulls the link arm 282 towards the cam assembly 166. As a result, the actuation spring 320 is compressed between bracket 232 and the shoulder 290, and the seal carrier 244 is moved upwardly into the channel 72 to a second or non-sealing position.

As depicted in FIG. 9, at a point of rotation of the cam 168 where the pin 188 reaches and passes the highest vertical point in its rotational path, a detente or over-center point occurs. The detente occurs because, for a short period of the rotation, the effective length of the strap 304 is not being shortened. At the detente point, the cam 168 will stay in a static rotational position about the axis 184. Therefore, the seal carrier 244 is held in the second position without the need to apply force to the actuation tool 210. In this position, the cam 168 is said to be in its detente or over-center position. The panel 28 can then easily be moved along the track 22 to a different location without the need for an operator to apply constant force to the actuation rod 204 to hold the seal carrier 244 in the non-sealing position.

When it is desired to move the seal member 242 outwardly such as to reengage the seal member 242 with a surface such as the floor, the actuation tool 210 is engaged with the second end 208 of the actuation rod 204, and turned in an opposite direction as shown by the arrow D in FIGS. 8 and 9. As the actuating rod 204 is turned, the cam 168 is rotated, and portions of the strap 304 are unwound from the cam 168, thereby lengthening the effective length of the strap 304. The effective lengthening of the strap 304 results in reducing the force pulling the link arm 282 towards the cam 168. As a result, the actuation spring 320 biases the seal carrier 244 from the second or non-sealing position into its first or sealing position. In this position, the cam 168 is said to be in the seal or rest position.

The cam stop 218 acts to prevent over-rotation of the cam 168 and functions as follows. Referring to FIGS. 8 and 9, when the cam 168 is in the seal position, the first end 190 of the pin 187, which extends through and beyond the cam disc 170, rests on the lip 229 of the cam stop 218. The lip 229 engages the end 190 of the pin 187, and prevents the cam 168 from further rotation in the direction shown by the arrow D. When the cam 168 is in the seal position, the cam stop 218 prevents over-rotation of the cam 168 in the direction shown by arrow D that could cause structural damage to the panel 28. The cam stop 218 allows the cam 168 to rotate from the seal position in the direction shown by the arrow C to the detente position.

When the cam 168 is in the detente position (FIG. 9), the first end 190 of the pin 187 rests on the second lip 231 of the cam stop 218. The second lip 231 engages the end 190 of the rod 187 and prevents the cam 168 from rotating in the direction shown by arrow C. The cam stop 218 thereby prevents over-rotation of the cam 168 that could cause structural damage to the panel 28 when the cam 168 is in the detente position.

Figure 12:
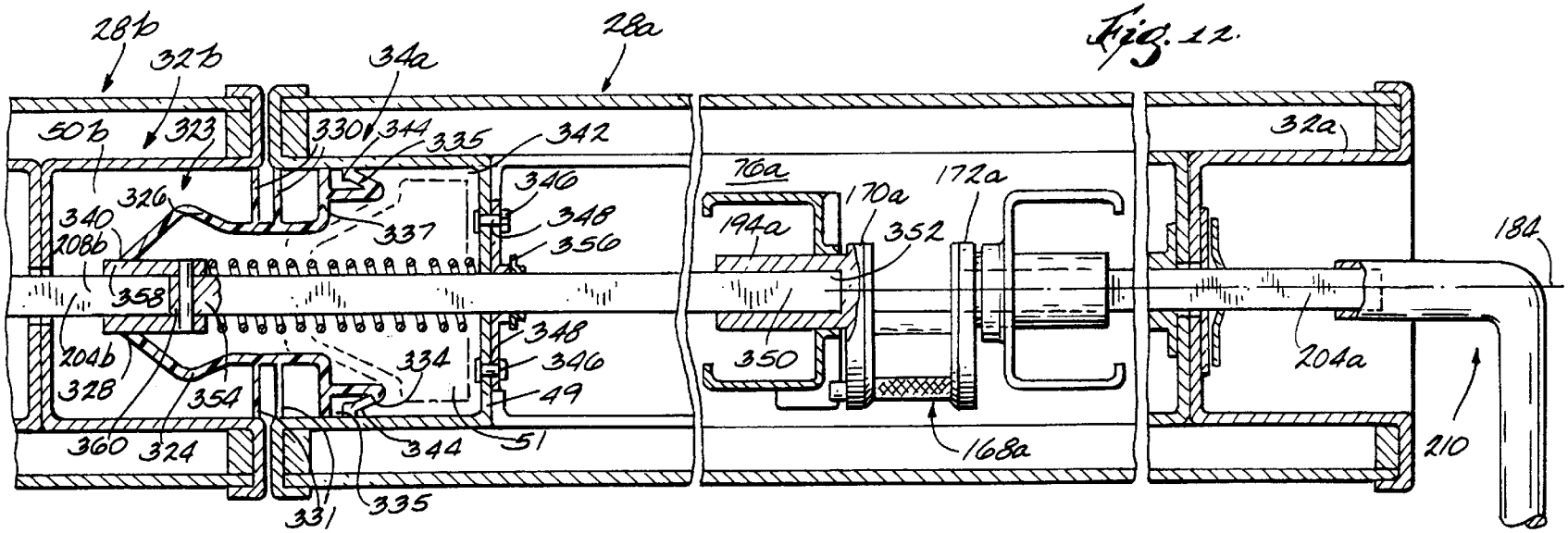
FIG. 12 is a sectional view taken along line 12—12 of FIG. 11.
Figure 11:
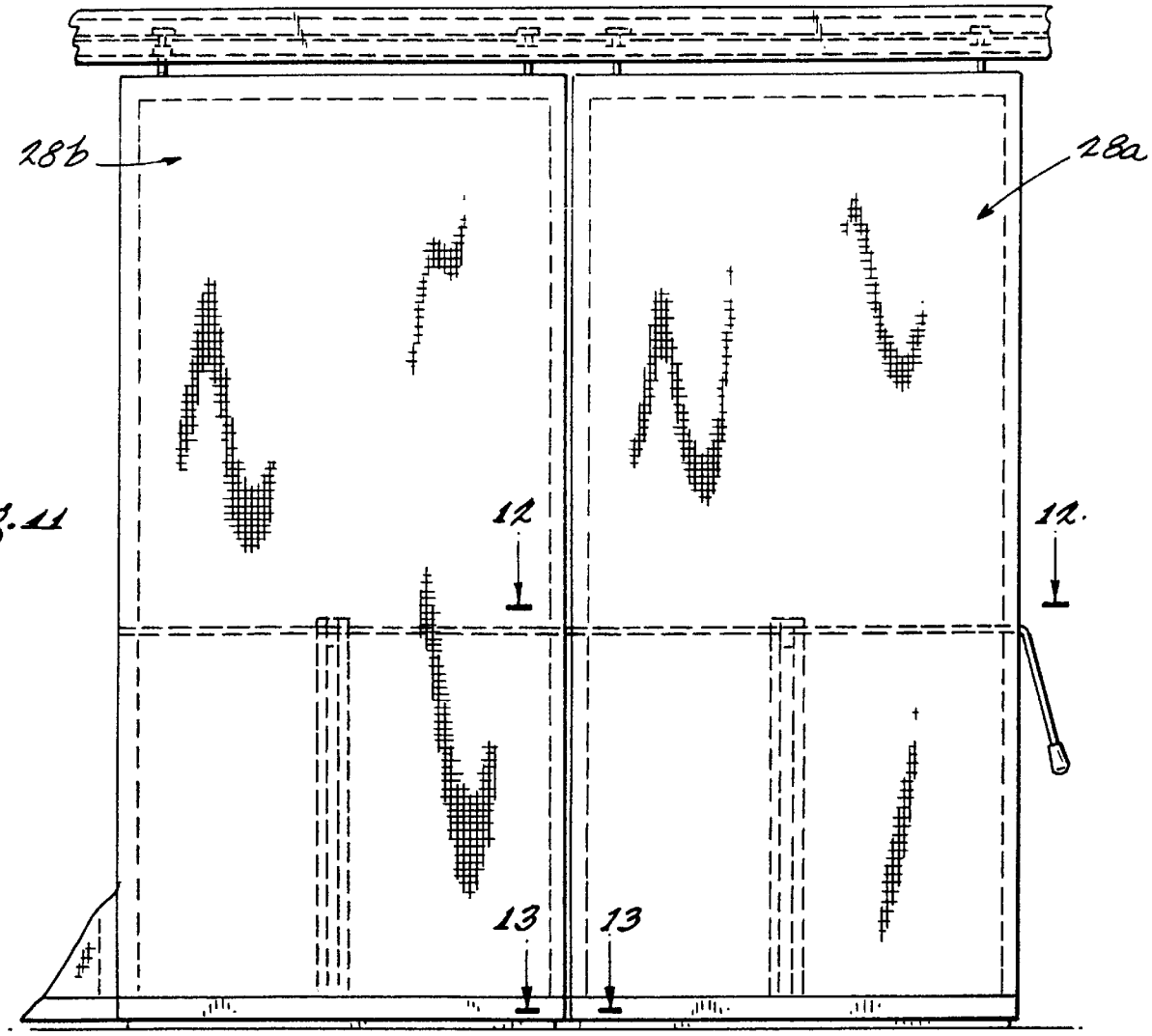
FIG. 11 is a front view of the two panels and a second embodiment of the seal mechanism.

Referring now to FIGS. 11–13, there is shown a second embodiment of the invention. The second embodiment enables the actuation of seal members on two or more panels that are interconnected. For simplicity, FIG. 11 depicts only two adjacent panels 28*a* and 28*b*. However, more than two panels can be interconnected and actuated with one actuating tool with similar modifications. The second embodiment is similar to the first embodiment of the invention as shown in FIGS. 1–9 with the following modification where like reference numerals refer to like elements.

As shown in FIGS. 11 and 12, the second embodiment includes a first panel 28*a* and a second panel 28*b*. Each of the two panels 28*a* and 28*b* have substantially identical structure. The panels 28*a* and 28*b* include structure that is adapted to allow the panels 28*a* and 28*b* to engage each other. More specifically and as best shown in FIG. 12, a trim member 323 is positioned between the side rails 34*a* of panel 28*a* and side rail 32*b* of the adjacent panel 28*b*. The trim member 323 is substantially U-shaped in cross section defined by two leg members 324 and 326 and a web 328 therebetween. Finger seals 330 and 331 are connected to and integral with the legs 324 and 326 respectively. Hook members 332 and 334 are connected to the leg members 324 and 326 respectively.

The channel 51 in the side rail 34*a* of the panel 28*a* is adapted to receive a portion of the trim member 323. The legs 324 and 326 of the trim member 323 are positioned within the channel 51. The trim member 323 is configured such that it engages the inner surface 335 of the side rail 34*a* without any significant air gaps. The web 328 of the trim member 322 and a portion of the legs 322 and 324 extend outward from the side rail 34*a*. The web 328 has an aperture 340 therein adjacent the axis 184.

The trim member 323 is positioned adjacent the web 49 of the side rail 34*a* with a plurality of trim braces 342, one of which is shown in phantom in FIG. 12. The trim braces 342 are substantially triangular in shape and include trim hook members 344 and rail engagement members 346. The rail engagement members 346 engage apertures 348 in the side rail 34*a* to connect the braces 342 to the side rail 34*a*. Hook members 332 and 334 of trim member 323 engage the hook members 344 of the braces 342 to connect the trim member 322 to the braces 342, thereby interconnecting the trim member 322 to the side rail 34*a*.

The first panel 28*a* is engaged with the second panel 28*b* such that side rail 34*a* of the first panel 28*a* abuts the side rail 32*a* of the second panel 28*a*. The trim member 323 substantially fits within and engages the channel 50 in side rail 32*b* of second panel 28*b*, thereby creating a seal between the first and second panels 28*a* and 28*b*.

Referring to FIG. 13, the convex second end 248*a* of the seal carrier 244*a* of the first panel 28*a* fits within the concave first end 246*b* of the seal carrier 244*b* of the second panel 28*b* as shown by the arrow, thereby creating a seal between the adjacent lower seal carriers 244*a* and 244*b*.

The seal mechanisms of each panel 28*a* and 28*b* are identical to the seal mechanisms described with respect to the first embodiment with the addition of a second actuation rod 350. The rod 350 has the same configuration as the rod 204*a*. A first end 352 of the rod 350 engages the cam disc 170*a*. The rod 350 thereafter extends through the socket 194*a* through the interior of the panel 76*a*, through the aperture 60*a* of the side rail 34*a*, through the trim member 323, and terminates in a second end 354. A bearing assembly 356 is housed in the opening 60*a* in the side rail 34*a*, and surrounds the rod 350 at the point where the actuation rod 350 extends through the opening 60*a*. The bearing assembly 356 rotatably supports the rod 350 for rotation about the axis 184.

As shown in FIG. 12, a mechanical socket member 358 is attached to the second end 354 of the rod 350. The socket member 358 has therein a socket 360 that is adapted to receive and engage the end 208*b* of the actuation rod 204 of the adjacent panel 28*b*. It should be noted, however, that many structures and methods may be use to provide for operational engagement of the actuation rods 204 and 350 between adjacent panels.

In operation, the actuation tool 210 is engaged with the end 208*a* of the actuation rod 204 of the first panel 28*a*. As the actuation tool 210 is rotated, the actuation rod 204*a*, the cam 168*a*, and the actuation rod 350 of the first panel 28*a* are rotated about the axis 184. Additionally, because the second end 354 of the actuation rod 350 is engaged with the end 208*b* of the actuation rod 204*b* of the second panel 28*b*, the actuation rods 204*b* and the cam 168*b* of the second panel 28*b* are rotated simultaneously to selectively move the seal members of both panels in unison. Although only two adjacent panels 28*a* and 28*b* have been illustrated in the present embodiment, many adjacent panels may be interconnected such that the seal members of each panel can be so simultaneously actuated using one actuation tool.

Referring now to FIGS. 14–17, there is shown a third embodiment of the invention, wherein the seal mechanism 18 operates both upper and lower seal members. The third embodiment is similar to the first embodiment as shown in FIGS. 1–10 with the following modifications wherein like reference numerals refer to like elements.

Figure 14:
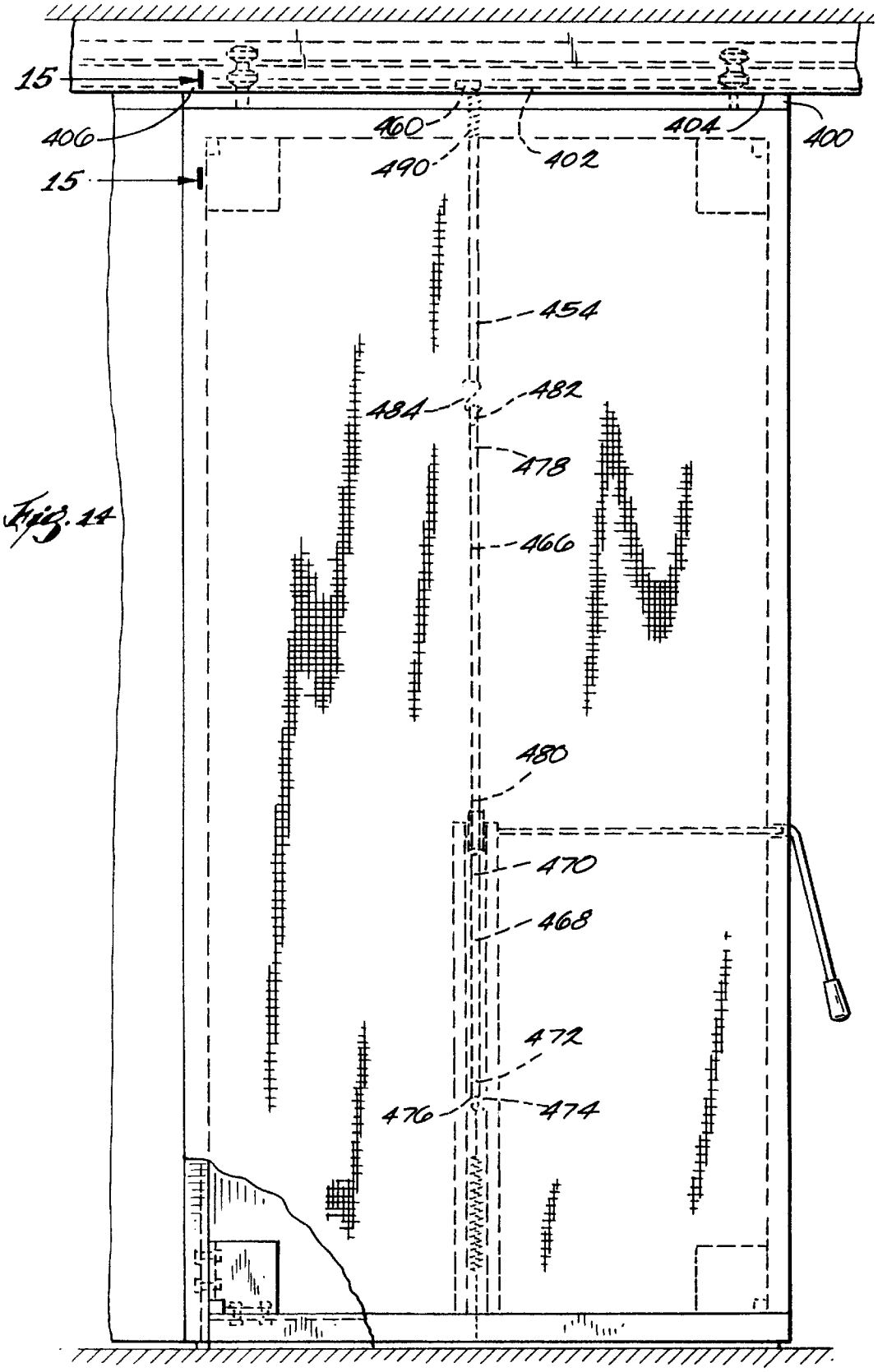
FIG. 14 is a front view of a seal mechanism and a partition arrangement in a third embodiment of the invention.
Figure 15:
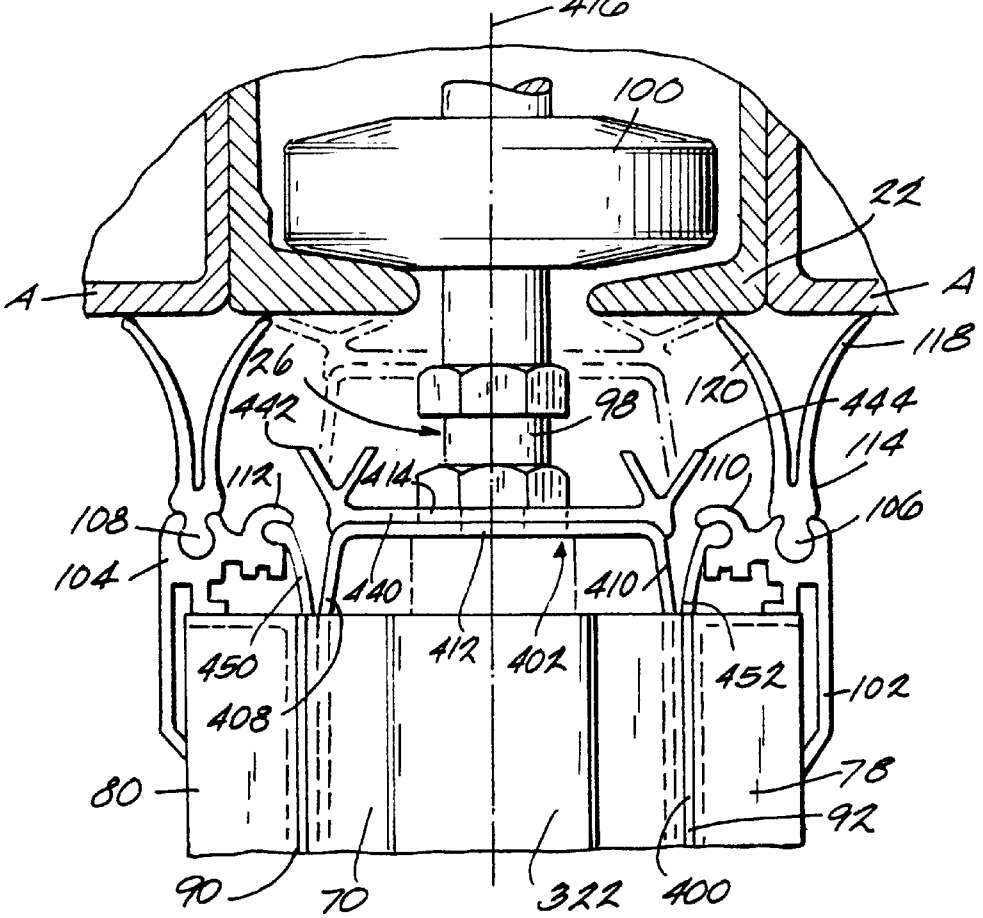
FIG. 15 is a sectional view along line 15—15 of FIG. 14.

As shown in FIGS. 14 and 15, the third embodiment includes an upper seal member 400. The seal member 400 includes an elongate upper seal carrier 402 that is generally U-shaped in cross-section and has a first end 404 and a second end 406. The seal carrier 402 includes legs 408 and 410 and a web 412 therebetween. An aperture 414 is formed in the web 412 about an axis 416 of the carrier bolt 98 so that the carrier bolt 98 can extend through the seal carrier 402. Preferably, the end 404 of the seal carrier 402 includes a trim member 250 as previously described and shown in FIG. 5 and the end 404 is configured like the end 248 also shown in FIG. 5.

Continuing to refer to FIG. 15, a seal shoe 440 is attached to the web 412 of seal carrier 402 with a fastener such as foam tape or screws. The seal shoe 440 includes two sweep seals 442 and 444.

A tadpole seal 450 is attached to the trim member 104 by tongue-and-groove engagement with the side groove 112, and a tadpole seal 452 is attached to the trim member 102 by tongue-and-groove engagement with the side groove 110. The tadpole seals 450 and 452 extend inwardly and downwardly from the upper trim members 102 and 104. A portion of each tadpole seals 450 and 452 is positioned between the top rail 66 and the seal carrier 402 for frictional engagement to create a seal between the seal carrier 402 and the top rail 66. The tadpole seals 450 and 452 enhance the panels 28's effectiveness as a barrier by blocking air and noise from flowing between the seal carrier 402 and the top rail 66.

As best shown in FIG. 15, the channel 70 in the top rail 66 is adapted to house at least a portion of the seal carrier 402. The legs 408 and 410 of seal carrier 402 fit within the channel 70 formed by the legs 90 and 92 of the top rail 66. The seal carrier 402 is configured such that it fits within the top rail 66 without any significant air gaps. The seal carrier 402 is designed so that is may be moved into and out of the channel 70 in a vertical direction as shown in phantom in FIG. 15.

Figure 16:
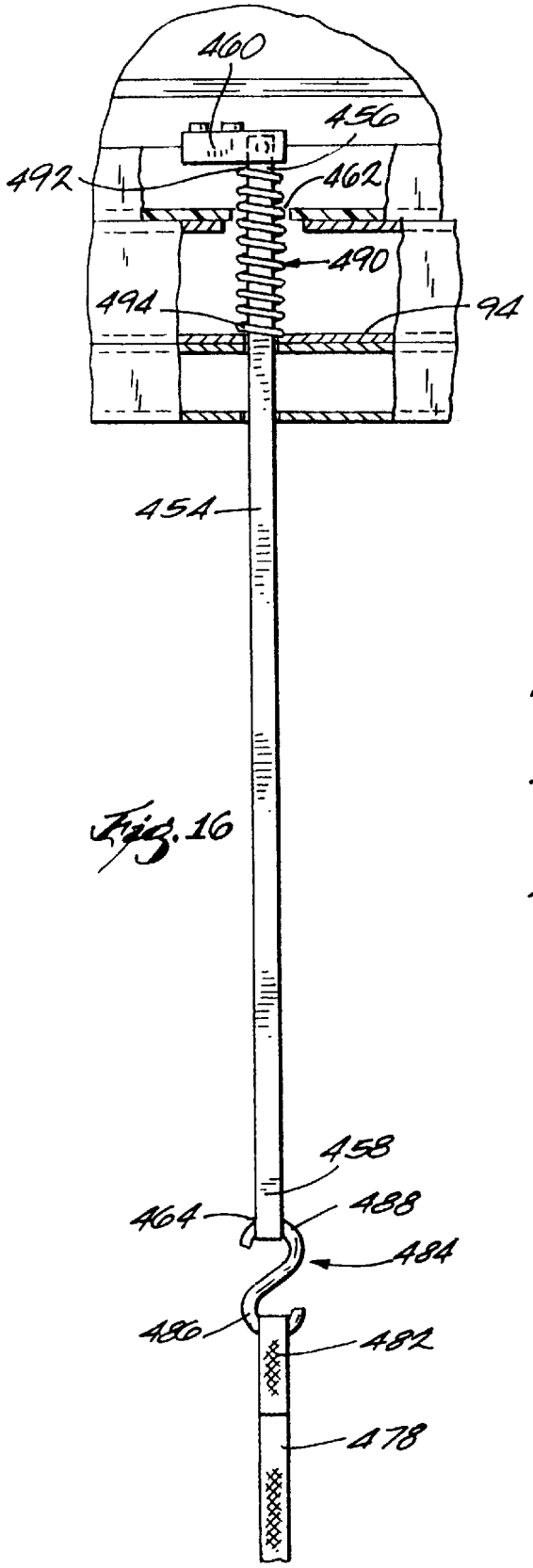
FIG. 16 is a partial front view of the third embodiment.

Referring to FIG. 16, the upper seal member 400 further includes a link arm 454. The upper link arm 454 has a first end 456 and a second end 458. The end 456 is secured to the seal carrier 402 via a mounting bracket 460. The link arm 454 extends downwardly from the mounting bracket 460 through an opening 462 in the top rail 66. The second end 458 of link arm 454 has an aperture 464 therein. Preferably, the link arm 454 is an elongated metal rod, however, other materials and structures can be used.

Figure 17:
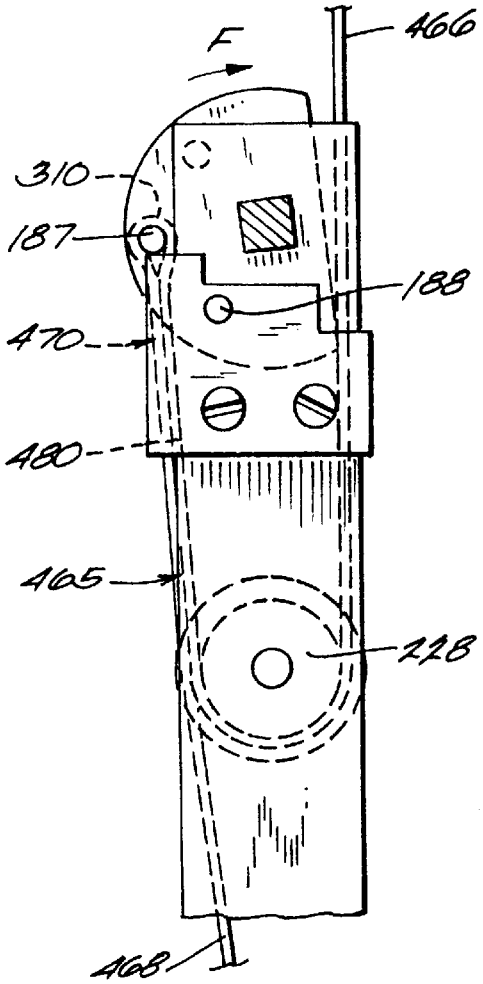
FIG. 17 is a side view of the third embodiment.

Referring to FIGS. 14 and 17, a strap 465 has a first portion 466 and a second portion 468, and the loop 310 formed therein separates the portion 466 from the portion 468. The bottom portion 468 has a top end 470 and a bottom end 472. The top end 470 is interconnected with the loop 310. The loop 310 extends around the pin 187 of the cam 168, thereby connecting the strap 365 to the cam 168. The portion 468 of the strap 465 extends downwardly towards the link arm 282 as previously described with respect to the first embodiment.

The portion 466 of the strap 365 has a top end 478 and a bottom end 480. The end 480 is adjacent the loop 310, thereby connecting the portion 466 to the cam 168. As best seen in FIG. 17, the top 466 of the strap 465 then extends downwardly towards the spool 228, extends around and engages the spool 228 to reverse its direction, and then extends upwardly towards the upper link arm 454. As best shown in FIG. 16, the end 478 has a loop 482 thereon that is connected to an S-hook 484. One end 486 of the S-hook 484 is bound in the loop 482 and the other end 488 is bound in the aperture 464 in the link arm 454. It should be noted that although an S-hook 484 is shown, different connecting means may be used to connect the strap 465 to the link arm 454 such as directly securing the strap 465 to the link arm 454.

Continuing to refer to FIG. 16, a biasing member such as spring 490 surrounds a portion of the link arm 454. The spring 490 extends from the bracket 460 to the web 94 of the top rail 66. The spring 490 has a first end 492 abutting the bracket 460 and a second end 494 abutting the web 94 of the top rail 66. Although the illustrated embodiment shows the biasing member as a spring surrounding the link arm 454, other biasing means may be used.

In operation, the spring 490 reacts against the mounting bracket 460 and the top rail 66 to provide an upward force upon the mounting bracket 460, therefore biasing seal carrier 402 outwardly and into sealing engagement with a surface such as a ceiling above the panel 28. The springs 490 and 320 in conjunction with the link arms 454 and 282 act as means for extending the seal carriers 402 and 244 from the panel.

The invention also includes means for moving the seal members 242 and 400 toward the panel so as to withdraw the seal members 400 and 242 from sealing engagement with surfaces such as the ceiling and floor respectively. The operation of the cam 168 of the third embodiment is substantially identical to the first embodiment, with the addition of the upper seal member 400.

When it is desired to move the upper and lower seal members 400 and 242 into the panel 28, the actuation tool 210 is engaged with the second end 208 of the actuation rod 204, and turned as shown by the arrow F in FIG. 17. As the actuating rod 204 is rotated, the cam assembly 166 rotates, and a portion of the upper and lower portions 466 and 468 of the strap 365 are wound onto the cam 168 about the pins 186 and 188 thereby shortening the effective length of the upper and lower portions 466 and 468 of the strap 365. The effective shortening of the upper and lower portions 466 and 468 of the strap 365 results in a force that pulls the upper and lower link arms 454 and 282 towards the cam assembly 166. As a result, the springs 490 and 320 are compressed, and the upper and lower seal carriers 402 and 244, move downwardly and upwardly respectively into non-sealing positions.

The cam 168 in the third embodiment includes the same detente position and rest position as in the first embodiment. When the cam 168 member is in the detente position, both upper and lower seal carriers 402 and 244 are held in non-sealing positions. When the cam 168 is in the rest position, the upper and lower seal carriers 402 and 244 are biased outwardly.

In practicing the invention, an embodiment may include only the bottom operable seal, or only the top operable seal, or both. Additionally, the embodiment may include one or more panels interconnected so that a single actuation tool can operate a series of seal mechanisms.

As can be appreciated by one of ordinary skill in the art, the invention may also include a panel with horizontally operable seals for sealing engagement with surfaces such as walls, other partitions, or other structures that are located horizontally in relation to the panel. Such horizontally operable seals would operate in the same general manner as the vertically operable seals as discussed above, but in a horizontal plane rather than a vertical plane.

We claim:

1. A partition comprising:

a panel having an interior;

a seal member moveable with respect to said panel;

a rotatable cam housed in said interior; and a flexible connector extending between said seal member and said cam;

whereby rotation of said cam in a first direction unwinds said flexible connector from around said cam and allows said seal member to move away from said panel to a first position and rotation of said cam in a second direction winds said flexible connector around said cam and moves said seal member toward said panel to a second position.

2. A partition as set forth in claim 1 wherein when said seal member is in said second position, said seal member is housed substantially in said interior of said panel.

3. A partition as set forth in claim 1 wherein said seal member includes a frame with at least one flexible seal extending therefrom.

4. A partition as set forth in claim 3 wherein said frame is U-shaped.

5. A partition as set forth in claim 1 wherein said seal member includes a link arm and wherein said connector is secured to said link arm.

6. A partition as set forth in claim 1 wherein said cam includes a pair of spaced discs having at least one pin extending therebetween.

7. A partition as set forth in claim 6 wherein said discs are generally semi-circular.

8. A partition as set forth in claim 1 wherein said cam has a rest position and wherein when said cam is in said rest position, said seal member is in said first position.

9. A partition as set forth in claim 1 wherein said cam has an over-center position and wherein when said cam is in said overcenter position, said seal member is in said second position.

10. A partition as set forth in claim 1 wherein when said seal member is in said second position, said cam is in an over-center position preventing further movement of said cam in said second direction.

11. A partition as set forth in claim 1 wherein said connector includes a flexible strap.

12. A partition as set forth in claim 11 wherein said connector further includes a hook.

13. A partition as set forth in claim 1 and further including a support in said interior of said panel that rotatably supports said cam.

14. A partition as set forth in claim 13 wherein said support includes two elongate columns and wherein said cam is positioned between said columns.

15. A partition as set forth in claim 1 and further including a cam rotator connected to said cam for manually rotating said cam.

16. A partition as set forth in claim 15 wherein said cam rotator includes an actuator tool that is in communication with said cam to manually rotate said cam.

17. A partition as set forth in claim 1 and further including a biasing member communicating with said seal member for biasing said seal member in said first position.

18. A partition as set forth in claim 17 wherein said biasing member is a spring.

19. A partition as set forth in claim 5 and further including a biasing member communicating with said seal member for biasing said seal member in said first position, and wherein said biasing member surrounds said link arm.

20. A partition as set forth in claim 1 and further including a bracket in communication with said cam for limiting the rotational movement of said cam in said first direction.

21. A partition as set forth in claim 1 and further including a bracket in communication with said cam for limiting the rotational movement of said cam in said second direction.

22. A partition as set forth in claim 19 and further including a second bracket wherein said biasing member is housed between said seal member and said second bracket.

23. A partition as set forth in claim 1 and further including a second seal member moveable with respect to said panel, wherein said connector is in communication with said second seal member, and wherein rotation of said cam in said first direction moves said second seal member away from said panel to a second position and rotation of said cam in said second direction moves said second seal member toward said panel to a second position.

24. A partition as set forth in claim 1 wherein said seal member is a vertically operable seal member.

25. A partition as set forth in claim 1 wherein when said seal member is a horizontally operable seal member.

26. A partition comprising:

a panel having an interior; and a sealing mechanism, said mechanism including:

a moveable seal member;

a cam support housed in said interior;

a rotatable cam supported by said cam support, said cam including a pair of spaced parallel discs and a pin extending between and orienting said discs;

a flexible connector secured to said pin and connectable to said seal member;

wherein rotation of said cam in a first direction moves said seal member into a first position and rotation of said cam in a second direction moves said seal member into a second position.

27. A partition as set forth in claim 26 wherein when said seal member is in said first position, said seal member extends outwardly from said panel.

28. A partition as set forth in claim 27 wherein when said seal member is in said second position, said second seal member is housed substantially in said interior of said panel.

29. A partition as set forth in claim 26 wherein said seal member includes a frame with at least one flexible seal extending therefrom.

30. A partition as set forth in claim 26 wherein said seal member includes a link arm and wherein said connector is secured to said link arm.

31. A partition as set forth in claim 26 wherein said discs are generally semi-circular.

32. A partition as set forth in claim 26 wherein said cam has a rest position and wherein when said cam is in said rest position, said seal member is in said first position.

33. A partition as set forth in claim 26 wherein said cam has an over-center position and wherein when said cam is in said overcenter position, said seal member is in said second position.

34. A partition as set forth in claim 26 wherein when said seal member is in said second position, said cam is in an over-center position preventing further movement of said cam in said second direction.

35. A partition as set forth in claim 26 wherein said connector includes a strap.

36. A partition as set forth in claim 26 wherein said support includes two elongate columns and wherein said cam is positioned between said columns.

37. A partition as set forth in claim 26 and further including a cam rotator connected to said cam for manually rotating said cam.

38. A partition as set forth in claim 26 and further including a biasing member communicating with said seal member for biasing said seal member in said first position.

39. A partition as set forth in claim 38 wherein said biasing member is a spring.

40. A partition as set forth in claim 26 and further including a bracket in communication with said cam for limiting the rotational movement of said cam in said first direction and in said second direction.

41. A partition as set forth in claim 39 and further including a second bracket and wherein said spring is housed between said seal member and said second bracket.

42. A partition as set forth in claim 26 wherein when said seal member is in said first position, said seal member extends vertically away from said panel.

43. A partition as set forth in claim 26 wherein when said seal member is in said first position, said seal member extends horizontally away from said panel.

44. A partition comprising:

a panel having an interior;

a moveable first seal member;

a moveable second seal member;

a rotatable cam housed in said interior; and a flexible connector in communication with said first and second seal members;

whereby movement of said cam in a first direction unwinds said flexible connector from around said cam and moves said first seal member and said second seal member to a first position extending outwardly from said panel and movement of said cam in a second direction winds said flexible connector around said cam and moves said first seal member and said second seal member into a second position in said interior of said panel.

45. A partition as set forth in claim 44 wherein said seal member includes a frame with at least one flexible seal extending therefrom.

46. A partition as set forth in claim 44 wherein said cam includes a pair of spaced discs having at least one pin extending therebetween.

47. A partition as set forth in claim 44 wherein said cam has a rest position and wherein when said cam is in said rest position, said seal member is in said first position and wherein said cam has an over-center position and wherein when said cam is in said overcenter position, said seal member is in said second position.

48. A partition as set forth in claim 44 wherein said connector includes a flexible strap.

49. A partition as set forth in claim 44 and further including a support in said interior, wherein said support includes two elongate columns and wherein said cam is positioned between said columns.

50. A partition as set forth in claim 44 and further including a means for biasing said first and said second seal members in said first positions.

51. A partition as set forth in claim 44 and further including a bracket in communication with said cam for limiting the rotational movement of said cam.

52. A partition as set forth in claim 44 wherein said panel has a first end and a second end and wherein said first seal member is located at said first end and said second seal member is located at said second end.

53. A partition as set forth in claim 44 wherein when said first and second seal members are in said respective second positions, said first and said second seal members are housed substantially in said interior of said panel.

54. A partition as set forth in claim 44 wherein said connector is a strap having a first end and a second end, wherein said first end is secured to said first seal member and said second end is secured to said second seal member.

55. A partition as set forth in claim 44 and further including a roller spaced from said cam and wherein said strap has a length that extends from said first end secured to said first seal member, to said cam wherein a portion of strap is secured to said cam, around said roller to change directions, then to said second end that is secured to said second seal member.

56. A partition as set forth in claim 44 wherein said seal member is a vertically operable seal member.

57. A partition as set forth in claim 44 wherein when said seal member is a horizontally operable seal member.

58. A seal mechanism for at least two partitions, said mechanism comprising:

a first panel having an interior;

a first seal member moveable with respect to said first panel;

a rotatable first cam housed in said interior of said first panel;

a first connector extending between said first seal member and said first cam;

a second panel having an interior;

a second seal member movable with respect to said second panel;

a rotatable second cam housed in said interior of said second panel;

a second connector extending between said second seal member and said second cam; and means for rotating said cams simultaneously such that rotation of said first and second cams in a first direction moves said first and second seal members away from said respective first and second panel to a respective first position and rotation of said first and second cams in a second direction moves said first and second seal members toward said respective first and second panel to a second position.

59. A partition as set forth in claim 58 wherein when said seal member is in said first position, said seal member extends vertically away from said panel.

60. A partition as set forth in claim 58 wherein when said seal member is in said first position, said seal member extends horizontally away from said panel.

61. A partition comprising:

a panel having an interior;

a seal member moveable with respect to said panel;

a rotatable cam housed in said interior, wherein said cam includes a pair of generally semi-circular spaced discs having at least one pin extending therebetween; and a connector extending between said seal member and said cam;

whereby rotation of said cam in a first direction moves said seal member away from said panel to a first position and rotation of said cam in a second direction moves said seal member toward said panel to a second position.

62. A partition comprising:

a panel having an interior;

a moveable first seal member;

a moveable second seal member;

a rotatable cam housed in said interior;

a roller spaced from said cam;

a connector in communication with said cam and said first and second seal members, said connector having a length that extends from a first end secured to said first seal member, to said cam wherein a portion of said connector is secured to said cam, around said roller to change directions, then to a second end that is secured to said second seal member;

whereby movement of said cam in a first direction moves said first seal member and said second seal member to a first position extending outwardly from said panel and movement of said cam in a second direction moves said first seal member and said second seal member into a second position in said interior of said panel.

* * * * *